US009822571B2

(12) United States Patent
Reinke et al.

(10) Patent No.: US 9,822,571 B2
(45) Date of Patent: Nov. 21, 2017

(54) WINDOW CLAMP AND ASSEMBLY FOR WINDOW REGULATOR

(71) Applicant: HI-LEX CONTROLS INC., Rochester Hills, MI (US)

(72) Inventors: Ryan Reinke, Southfield, MI (US); Masayuki Matsushita, Rochester Hills, MI (US)

(73) Assignee: Hi-Lex Controls Inc., Rochester Hills, MI (US)

( * ) Notice: Subject to any disclaimer, the term of this patent is extended or adjusted under 35 U.S.C. 154(b) by 2 days.

(21) Appl. No.: 15/048,542

(22) Filed: Feb. 19, 2016

(65) Prior Publication Data

US 2017/0241181 A1 Aug. 24, 2017

(51) Int. Cl.
*E05F 11/38* (2006.01)
*E06B 3/54* (2006.01)

(52) U.S. Cl.
CPC ..... *E05F 11/385* (2013.01); *E06B 3/5445* (2013.01); *E05F 2011/387* (2013.01)

(58) Field of Classification Search
CPC ..... E05F 11/385; E05F 11/483; E05F 11/382; E05F 2011/387; E05F 15/689; E06B 3/5445; E06B 3/5454; E05Y 2900/55
See application file for complete search history.

(56) References Cited

U.S. PATENT DOCUMENTS

| | | | | |
|---|---|---|---|---|
| 4,866,895 | A * | 9/1989 | Hlavaty | B60J 1/17 52/204.597 |
| 5,546,704 | A * | 8/1996 | Maruoka | B60J 1/17 49/375 |
| 5,687,506 | A | 11/1997 | Davies et al. | |
| 5,749,174 | A | 5/1998 | Mariel | |
| 5,799,449 | A | 9/1998 | Lyons et al. | |
| 5,992,099 | A * | 11/1999 | Thomas | E05F 11/385 49/375 |
| 6,119,403 | A * | 9/2000 | Klippert | E05F 11/382 49/375 |
| 7,908,795 | B2 | 3/2011 | Arimoto | |
| 8,146,293 | B2 | 4/2012 | Brownlie, Jr. et al. | |
| 8,966,820 | B2 * | 3/2015 | Broadhead | B60J 5/0416 49/348 |
| 2006/0130407 | A1 * | 6/2006 | Castellon | E05F 11/385 49/375 |

(Continued)

FOREIGN PATENT DOCUMENTS

WO WO 2010/135445 A2 11/2010

*Primary Examiner* — Justin Rephann
(74) *Attorney, Agent, or Firm* — Brinks Gilson & Lione

(57) ABSTRACT

A window clamp and assembly for an automotive window regulator assembly. The window clamp provided features a body foundation and a U-shaped bridge extending from the foundation configured to deflect away from the foundation to allow a window panel to be inserted into a slot of the window clamp. Claws formed on the bridge pass through and interlock with holes in the window panel to secure and support the panel. Shoulders formed on and protruding from the bridge guide the window panel into position and aid in supporting the panel. The window clamp design facilitates rapid and accurate assembly of the window clamp assembly while providing increased stability of the window panel and reduced size of the window clamp.

19 Claims, 8 Drawing Sheets

(56) References Cited

U.S. PATENT DOCUMENTS

| | | | | |
|---|---|---|---|---|
| 2008/0000160 | A1* | 1/2008 | Hernandez | E05F 15/689 49/352 |
| 2008/0244981 | A1* | 10/2008 | Arimoto | E05F 11/385 49/352 |
| 2008/0289256 | A1* | 11/2008 | Mangold | E05F 11/385 49/348 |
| 2009/0193718 | A1* | 8/2009 | Tudora | E05F 11/385 49/358 |
| 2009/0265993 | A1 | 10/2009 | Shah et al. | |
| 2010/0088964 | A1 | 4/2010 | Costigan et al. | |
| 2010/0313481 | A1* | 12/2010 | Brownlie, Jr. | E05F 11/385 49/372 |
| 2011/0023367 | A1 | 2/2011 | Barr et al. | |
| 2013/0152476 | A1* | 6/2013 | Reno | E05F 11/385 49/348 |

* cited by examiner

WINDOW CLAMP AND ASSEMBLY FOR WINDOW REGULATOR

FIELD OF THE INVENTION

This invention relates to a window clamp and a window clamp assembly used as a component of a window regulator for automotive vehicles.

BACKGROUND OF THE INVENTION

Passenger car motor vehicles have for many decades featured movable side door glass. A mechanism is required in order to move the glass between the upper closed position and the lower opened position. These mechanisms are generally known as window regulators. Window regulators can be manually operated, or can be driven by a powered actuator, most commonly using an electric motor. One type of window regulator uses a pulley arrangement with a metal cable wrapped around a drum driven by an electric motor. This device uses a carrier which engages the door glass and fastens it to the window regulator assembly to control its motion as it moves vertically.

Window regulator mechanisms may be categorized into groups which include dual rail and single rail types. In a dual rail system, a pair of separated rails is provided which each include a movable window clamp which is fastened to the lower edge of the glass and move in a synchronized manner to raise and lower the glass. In a single rail type, a single rail is positioned near the center of the glass panel and includes a carrier plate with a clamp assembly which engages a lower portion of the window. The carrier plate with the clamp assembly moves the window vertically along the rail between the open and closed positions. A single-rail window regulator requires fewer parts than a dual rail system and is lighter in weight, but poses design challenges in providing sufficient stability for the control of the glass motion since it is controlled by a single rail and a single carrier plate.

Window clamps typically attach at the lower edge of the glass through various approaches. One approach uses a clamp which pinches the glass for attachment. Another type inter-engages with a hole through the glass formed near the lower edge of the glass. In the conventional designs of the above-mentioned window glass clamp which fastens through a hole in the glass, it is necessary during its assembly for an operator to accurately position the clamp and force it into engagement with the window at the proper position such that an interlocking feature engages with the window glass hole. The necessity of accurately positioning the clamp in this manner gives rise to assembly difficulties and potential improper assembly situations.

Additional benefits and advantages of the present invention will become apparent to those skilled in the art to which the present invention relates from the subsequent description of the preferred embodiment and the appended claims, taken in conjunction with the accompanying drawings.

SUMMARY

The present disclosure provides a window clamp and assembly for a single rail window regulator capable of providing increased window panel stability and support while reducing the size and weight of a window clamp and number of components of a window regulator assembly.

According to an exemplary form of the present disclosure, a window clamp for an automotive window regulator assembly includes a foundation forming a shelf bordered on one side by a wall protruding from the foundation and on the other side by at least one tab protruding from the foundation. The tab and the wall opposing one another across the shelf. The window clamp further includes a U-shaped bridge. The U-shaped bridge includes a first arm and a second arm extending from the foundation and forms at least one claw disposed on a top portion of the bridge that spans the distance between the first and second arms. The bridge further forms a shoulder protruding from each of the arms. The clamp also includes a slot formed between the wall and the U-shaped bridge, the slot bottoms out at the shelf. The clamp may be formed using injection molding. The clamp may be used in conjunction with a single rail type window regulator.

According to another form of the present disclosure, the window clamp may be used in conjunction with a glass panel or window panel as a window clamp assembly. The window panel of the window clamp assembly has a lower edge and two holes or apertures through the glazing panel. The holes are positioned at predetermined locations relative to one another and the lower edge of the panel. The two holes and the inter-engaging features of the clamp provide enhanced stability and control of the position of the window glass while it is raised and lowered by the window regulator.

When the window clamp is used in conjunction with a window panel as a window clamp assembly, the panel may be inserted into the slot where the shelf engages the lower edge of the panel and the claws engage and interlock with the panel through the holes in the panel.

According to one aspect of the present disclosure, the U-shaped bridge of the window clamp is configured to bend away from the foundation by deflecting at a hinge region located along each of the arms. Furthermore, the arms of the bridge may have a tapered cross section such that the arms narrow near the foundation, thereby creating the hinge regions.

To increase structural rigidity and glass pull-off performance and reduce claw displacement, the top portion of the bridge may be reinforced with a plurality of truss structures. Such truss structures may be formed in the material of the top portion of the bridge.

According to another aspect of the present disclosure, shoulders of the window clamp act as guides for the glass panel and may be curved such that the shoulders maintain contact with or a substantially constant distance to the window panel even when the U-shaped bridge is deflected during insertion of the panel into the slot. Furthermore, the shoulders may be over-molded in thermoplastic elastomers to reduce noise generated by contact between the window panel and the shoulders.

Further areas of applicability will become apparent from the description provided herein. It should be understood that the description and specific examples are intended for purposes of illustration only and are not intended to limit the scope of the present disclosure

BRIEF DESCRIPTION OF THE DRAWINGS

In order that the disclosure may be well understood, there will now be described various forms thereof, given by way of example, reference being made to the accompanying drawings, in which.

The drawings described herein are for illustration purposes only and are not intended to limit the scope of the present disclosure in any way.

DETAILED DESCRIPTION OF THE INVENTION

Figure 1:
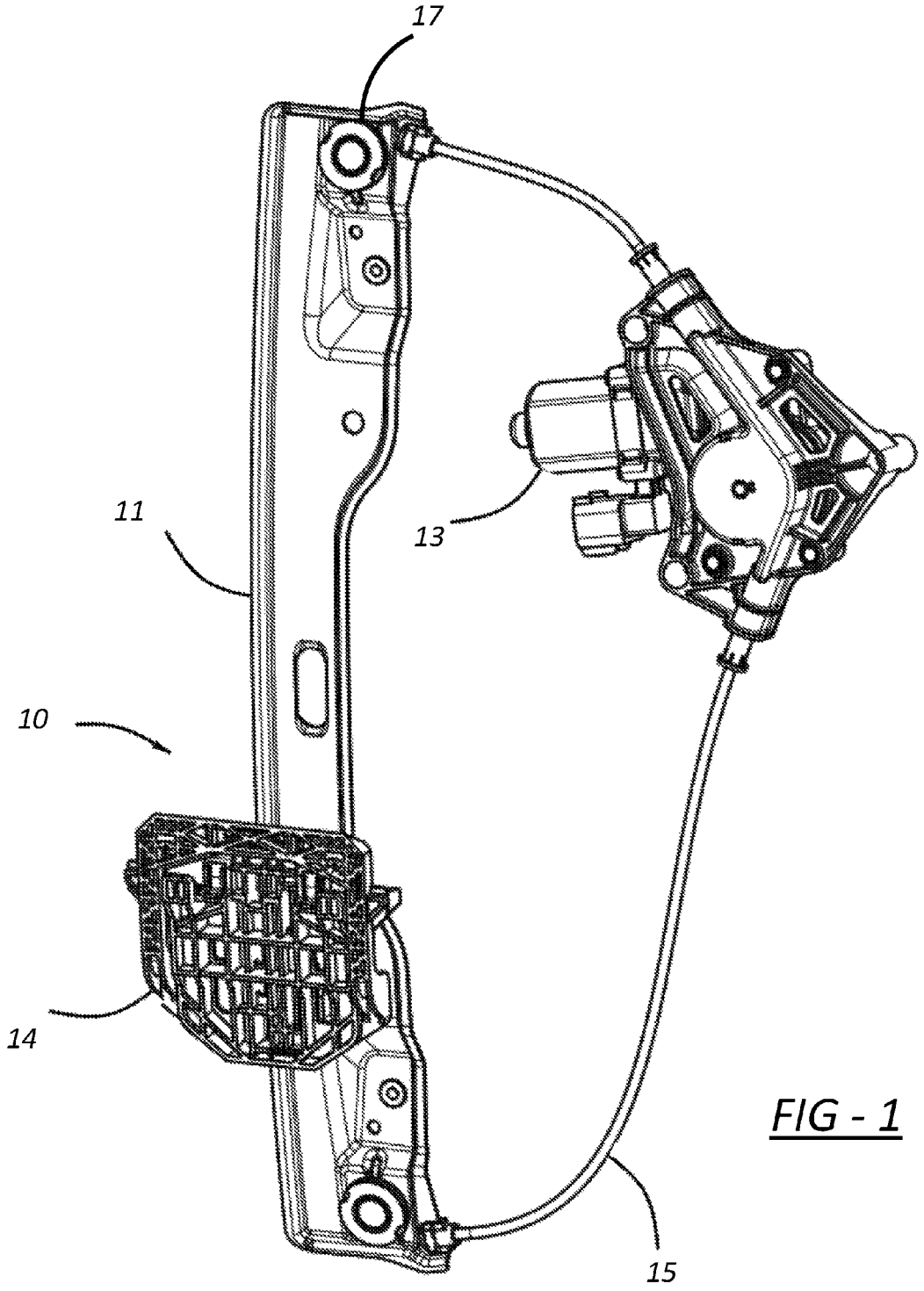
FIG. 1 is a pictorial view of a window regulator for an automobile including a window clamp assembly in accordance with this invention.
Figure 2:
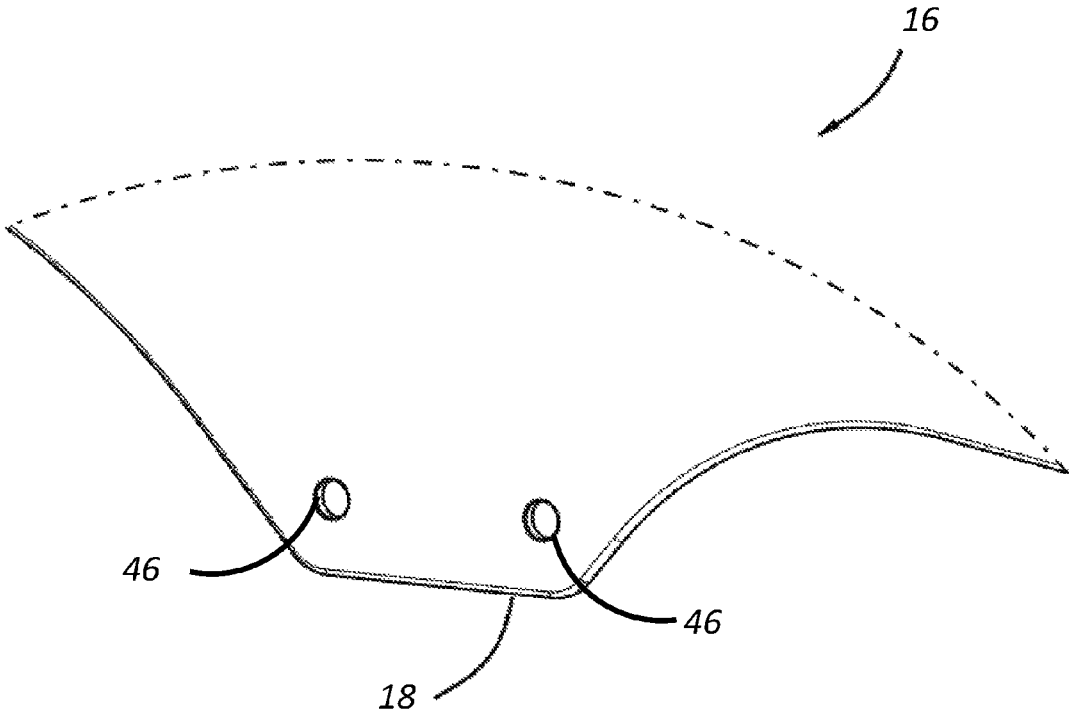
FIG. 2 is a pictorial view of a window in accordance with this invention.

FIG. 1 illustrates a window regulator 10 incorporating features in accordance with this invention. The window regulator 10 is shown as a representative unit which is used to raise and lower a glass panel of a window 16 (shown separately in FIG. 2). As shown, the window regulator 10 incorporates a guide rail 11. A window clamp 14 is provided which engages with guide rail 11 and moves between upper and lower positions to move the glass panel 16. The window regulator 10 is designed to be mounted inside the hollow portion of an automobile door. An electric motor 13 operates through a pulley system to drive cable 15 attached to the clamp 14 to move the clamp 14 between the raised and lowered positions. Cable 15 is guided by cable pulleys 17. The design of the window regulator 10 illustrated in FIG. 1 is merely illustrative of one of a number of types of window regulators which could incorporate the features of the present invention.

Figure 3:
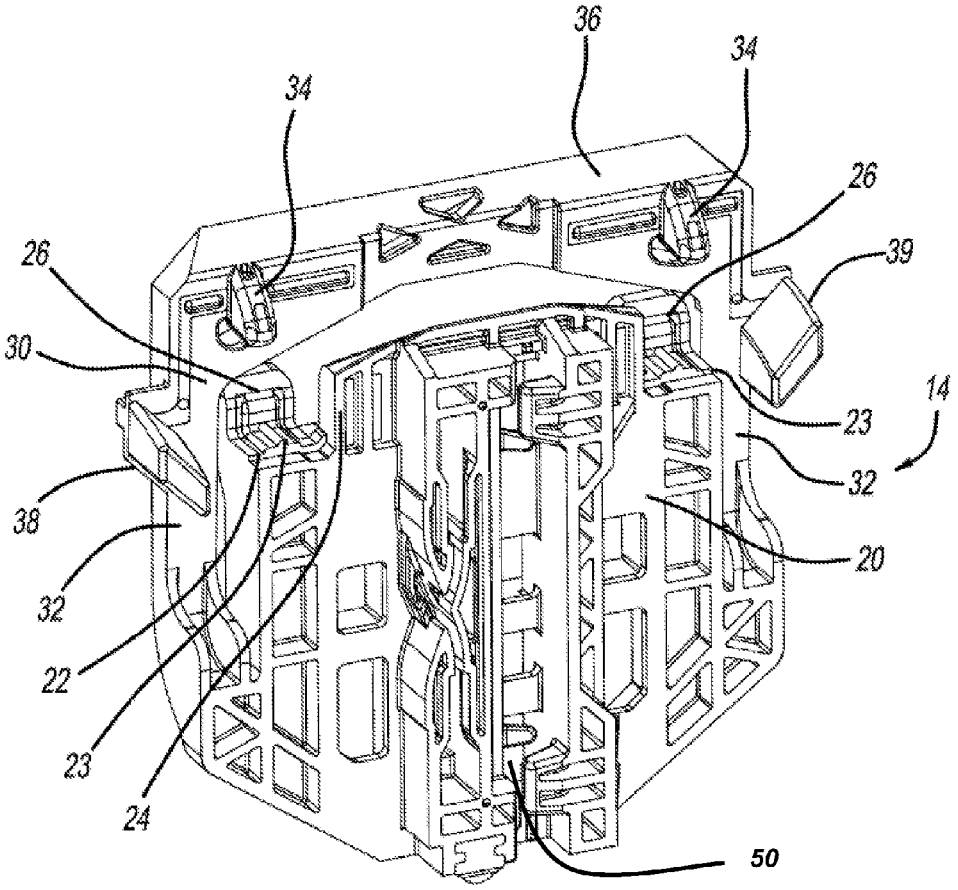
FIG. 3 is a pictorial view of a window clamp in accordance with this invention.
Figure 4:
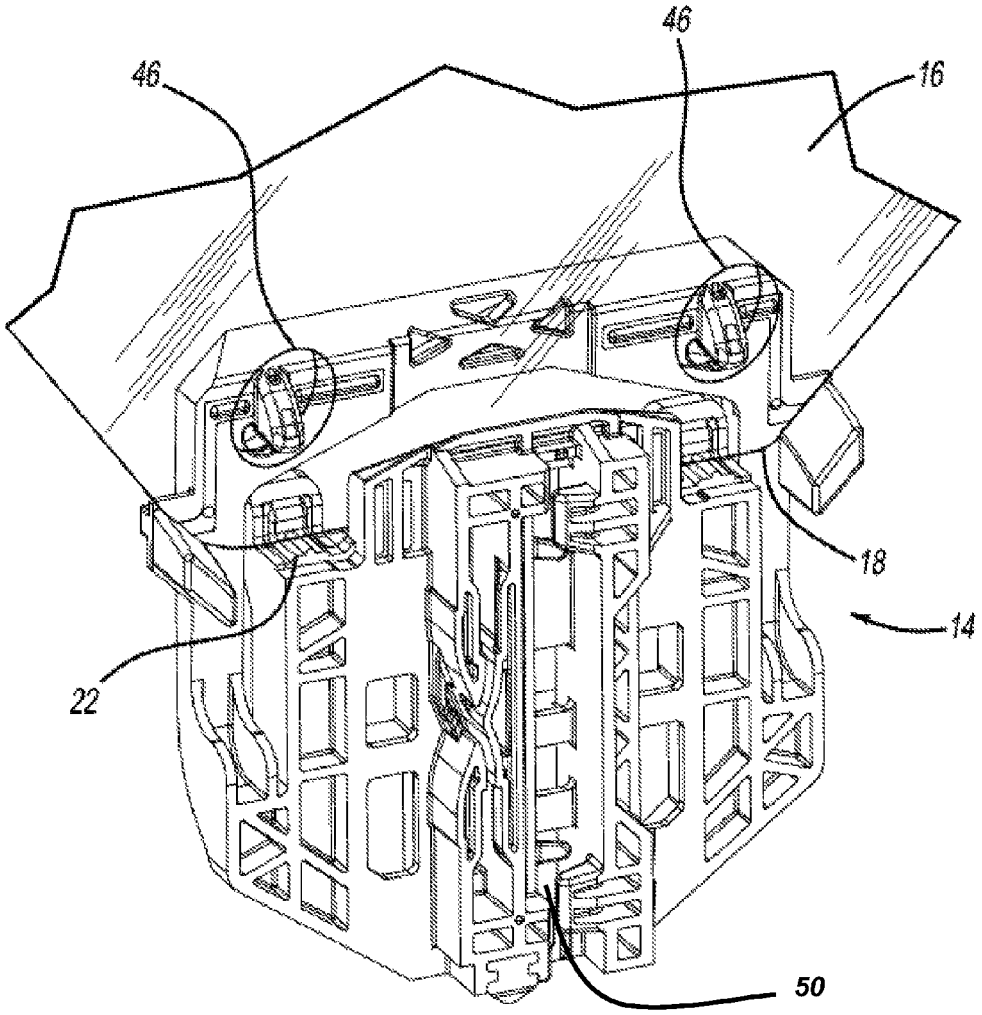
FIG. 4 is a pictorial view of a window clamp assembly in accordance with this invention comprising the window clamp shown in FIG. 3 and the window panel shown in FIG. 2.

FIGS. 2 through 8 illustrate the primary components of the window clamp assembly 12 in accordance with this invention which includes a clamp 14 configured to engage a glass panel of a window 16. As shown in FIG. 3, the window clamp 14 in accordance with this invention features a foundation 20 portion of the clamp 14 and a U-shaped bridge 30 portion. The clamp 14 may be formed as an injection molded polymer plastic part by an injection molding process. As shown in FIG. 4, the window clamp 14 may be used in conjunction with a glass panel of a window 16 to aid in supporting and securing the panel 16 as part of a window clamp assembly 12. In some embodiments, as shown in FIG. 1, the window clamp assembly 12 may further include a guide rail 11.

The foundation 20 forms a shelf 22. The shelf 22 and its surface may be substantially flat or any other geometry such that the shelf geometry corresponds to that of a lower edge 18 of the glass panel of a window 16 with which the window clamp 14 is used. The shelf 22 is configured to engage the lower edge 18 of a window panel 16. The shelf 22 may be covered, entirely or in part, by a pad 23 of soft material such as thermoplastic elastomers (TPE) to reduce noise and rattle caused by the engagement of the panel 16 and the shelf 22. The pads 23 may also aid in providing a secure fit between the glass panel 16 and the clamp 14. During insertion of the glass panel 16 into the clamp 14, the soft material of the pad 23 may allow the glass panel 16 to be pressed into the pad 23 prior to the clamp 14 snapping into interlocked engagement with the glass panel 16. As such, the pads 23 aid in providing a tight interlocking fit between the clamp 14 and the panel 16. The shelf 22 may be bordered on one side by a wall 24 protruding from the foundation 20 and by at least one tab 26 protruding from the foundation 20 on the side of the shelf 22 opposite the wall 24. The tabs 26 may be directly across from the wall 24 or may be placed beyond the sides of the wall 24 such that the tabs 26 do not directly oppose the wall 24. The tabs 26 may be over molded with a thermoplastic elastomer (TPE) material to further stabilize the glass panel 16 and reduce noise and vibration. In some embodiments, the window clamp 14 may further include a groove 50 formed in the foundation 20 to slidably engage with the guide rail 11. The groove 50 may be snapped onto the guide rail 11 such that the window clamp 14 may slide along the guide rail 11 between an upper, closed position and a lower, open position.

Figure 5:
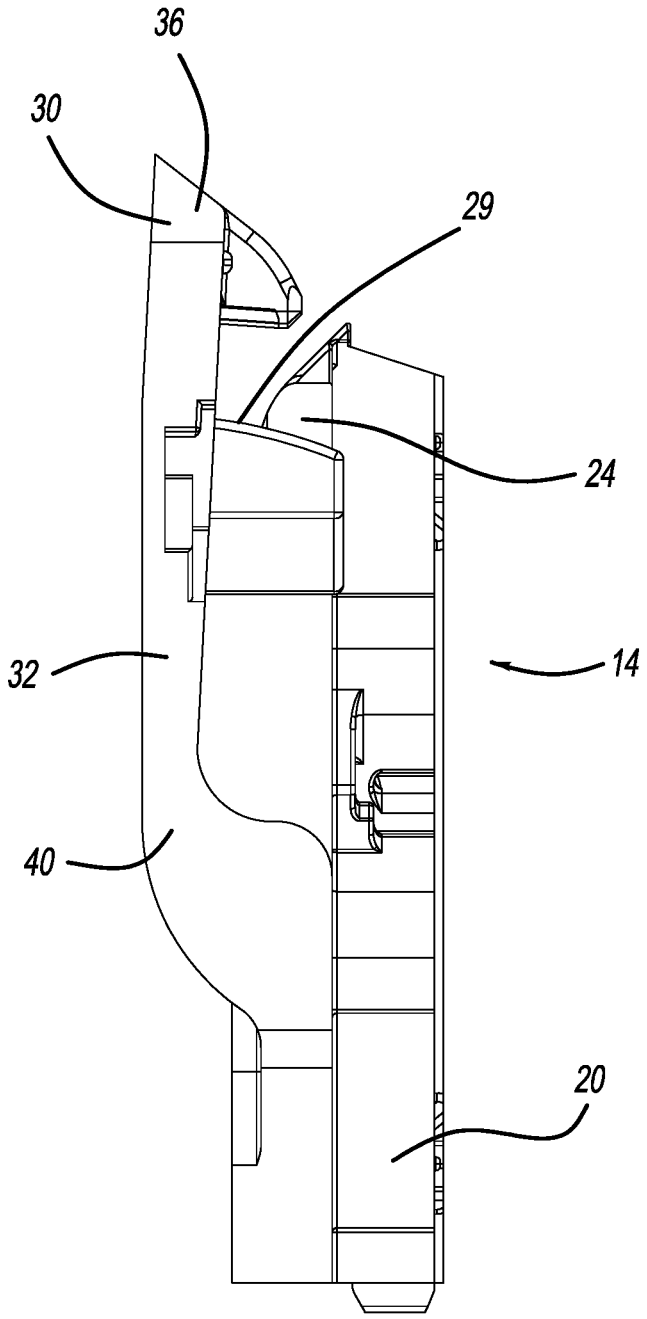
FIG. 5 is a pictorial view of a side of the window clamp shown in FIG. 2.
Figure 6:
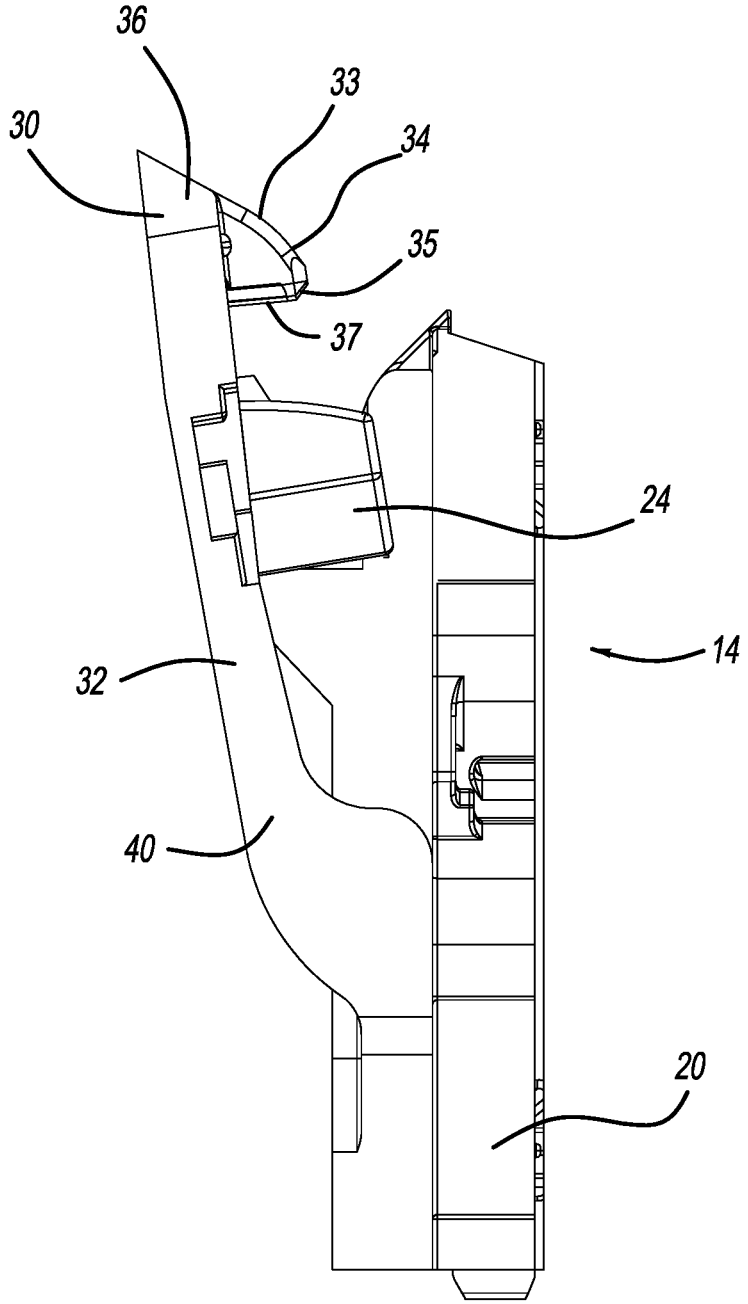
FIG. 6 is a pictorial view of the side of the window clamp shown in FIG. 2 with the bridge bent away from the foundation.
Figure 7:
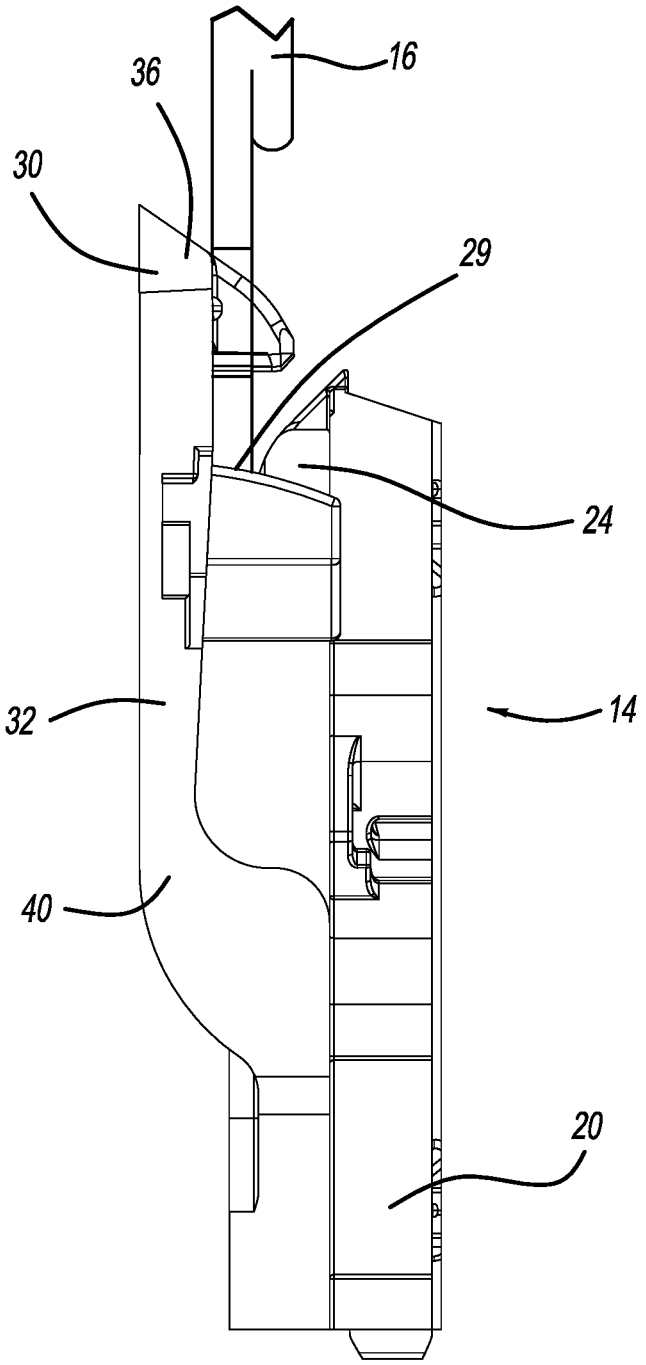
FIG. 7 is a pictorial view of a side of the window clamp assembly shown in FIG. 4.

The U-shaped bridge 30 may be integrally formed with the foundation 20 of the clamp 14. The U-shaped bridge 30 may have two arms 32 extending form the foundation 20. The arms 32 extend from the base or lower half of the foundation 20. As shown in FIG. 5, the arms 32 feature a curve near where the arms 32 connect to the foundation 20, allowing the U-shaped bridge 30 to be spaced apart from the rest of the foundation 20. The U-shaped bridge 30 is spaced apart from the rest of the foundation 20 such that a slot 28 is formed between the wall 24 and the bridge 30. According to one aspect of the present disclosure, the U-shaped bridge 30 is configured to bend away from the foundation 20 by deflecting at a hinge region 40 located along each arm 32. FIG. 6 shows the window clamp 14 with the U-shaped bridge 30 displaced away from the foundation 20. The hinge regions 40 may be located at the curve in the arms 32. The deflection of the arms 32 at the hinge regions 40 may be further facilitated by providing arms 32 having a tapered geometry or cross section, such that the arms 32 are narrow at the curve in the arms 32 near the point at which the arms 32 connect to the foundation 20. The placement of the hinge region 40 near the connection point to the foundation 20 allows for a relatively large displacement of top portion 36 of the bridge 30 and a lower overall material stress resulting in lower glass 16 insertion effort when placing the window panel 16 into the slot 28, as shown in FIG. 7.

The U-shaped bridge 30 features a first claw 34 integrally formed with and disposed on a top portion 36 of the bridge 30. FIG. 3 shows a first and second claw 34 disposed on the top portion 36 of the U-shaped bridge 30. The top portion 36 spans and connects the two arms 32 of the bridge 30. As best shown in FIGS. 5 and 6, the claws 34 may have a downward sloping upper surface 33 extending from the top portion 36 and ending in a downward pointing catch 35 that joins the sloped upper surface 33 and an underside 37 of the claw 34. FIG. 3 shows that the claws 34 are spaced at a predetermined, fixed distance from one another along the top portion 36. When a single claw 34 is disposed on the top portion 36 of the bridge 30, the claw 34 may be located near the center of the top portion 36 or, alternatively, the claw 34 may be positioned at some other point along the top portion 36. As shown in FIGS. 4 and 7, the claw 34 may be configured to mate or engage and interlock with at least one hole or aperture 46 in a glass panel 16. When two claws 34 are disposed on the top portion 36, a glass panel 16 having a first and second horizontally opposed hole or aperture 46 may be used. The first hole 46 in the window panel 16 is positioned within the panel 16 at a predetermined location relative to the lower edge 18 of the panel 16. The second hole 46 in the window panel 16 is positioned within the panel 16 at a predetermined location relative to the lower edge 18 and the first hole 46. The distance between the two holes 46 substantially corresponds to the distance between the snap-fit claws 34. The first claw 34 interlocks with the first hole 46 and the second claw 34 interlocks with the second hole 46. Providing two snap-fit claws 34 increases the span which the clamp 14 mates with a glass panel 16, thereby improving rotational stability of the panel 16, which relates to how well the glass 16 tracks while moving between an open and closed position in the door window.

Figure 8:
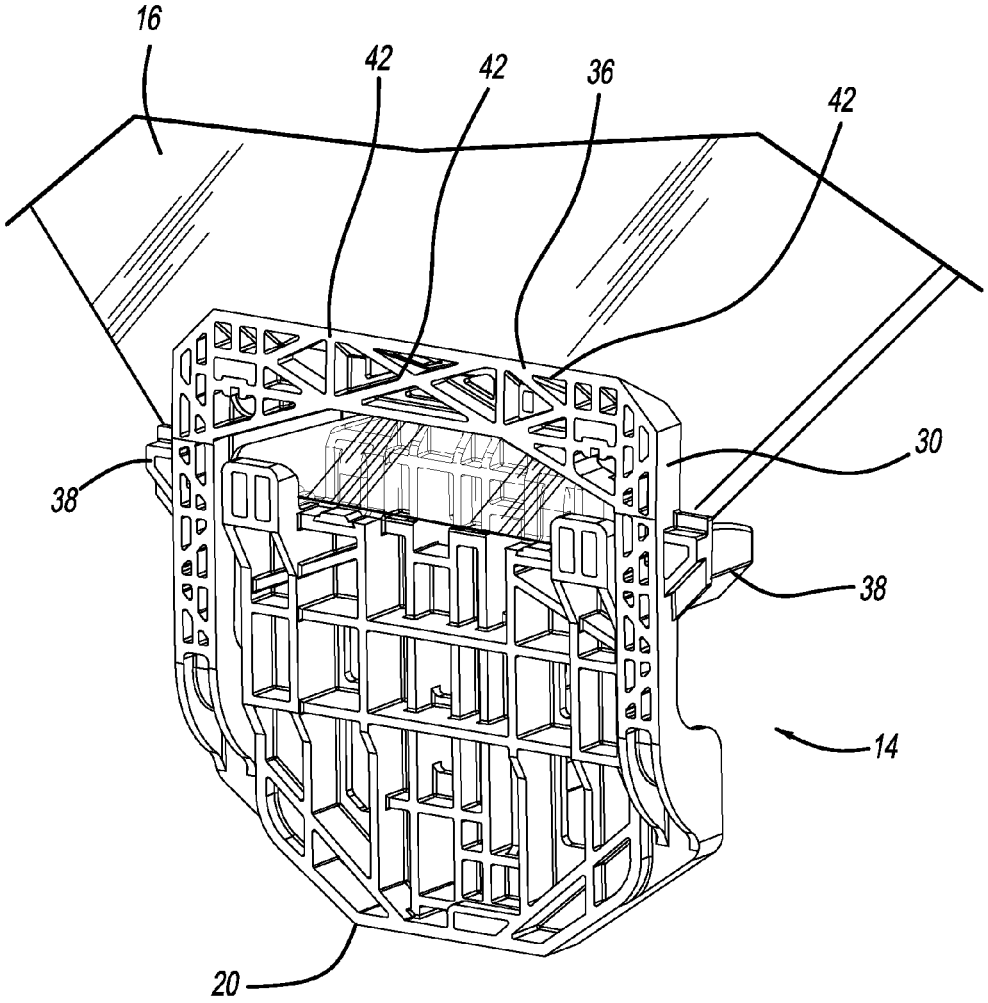
FIG. 8 is a pictorial view of the back of the window clamp assembly shown in FIG. 4.

According to one aspect of the present disclosure, the top portion 36 of the bridge 30 may be reinforced with truss structures 42 integrally formed in the material of the top portion 36 of the bridge 30, as shown in FIG. 8. Such reinforcements 42 aid in increasing the structural rigidity near the claws 34 and reduces the displacement of the claws 34 during the process of removing a glass panel 16 from the window clamp 14 when the clamp 14 is used in conjunction with a glass panel 16.

Referring against to FIGS. 3 and 5, the U-shaped bridge 30 further features a shoulder 38 integrally formed with and protruding from each of the arms 32 of the bridge 30. The shoulders 38 extend from the arms 32 at substantially the same level as the shelf 22. The shoulders 38 protrude from the arms 32 at a length long enough to extend beyond the slot 28, which bottoms out at the shelf 22. The placement of the shoulders 38 on the arms 32 allow the size of the window clamp 14 to be reduced as compared to clamps having shoulders placed on the static foundation portion of the window clamp. The shoulders 38 are positioned such that they may be used to guide a glass panel 16 into place on the window clamp 14 during assembly of the window clamp assembly 12. As shown in FIG. 6, the shoulders 38 move with the arms 32 to which they are attached as the U-shaped bridge 30 is deflected during glass panel 16 installation and removal. According to one aspect of the present disclosure, the shoulders 38 may have a curved shape or a curved surface, which maintains a constant distance to the glass panel 16 even while the U-shaped bridge 30 is deflected during glass installation. The shoulders 38 may also be used to provide stability to the glass panel 16. The shoulders 38 may be over-molded in thermoplastic elastomers (TPE) to reduce noise produced from contact between the glass panel 16 and the shoulders 38.

According to another aspect of the present disclosure, the window clamp 14 and window clamp assembly 12 may be used in conjunction with a single rail type window regulator as shown in FIG. 1. For single rail type window regulator applications, the window clamp 14 and the window clamp assembly 12 including the glass panel 16 of the present disclosure improve stability of the glass panel 16 as it moves between the open and closed positions. The engagement of the two claws 34 of the clamp 14 with the two holes 46 of the window panel 16, provide increased contact to support and stabilize the panel 16 on the clamp 14. In typical single rail applications, as the panel moves between open and closed positions, the glass will rock due to friction along the guide rail 11 and the single force application point acting on the window to move it. Providing two points of engagement between the claws 34 and the holes 46 improves the rotational stability and how well the panel 16 tracks while moving between the open and closed positions.

While the above description constitutes the preferred embodiment of the present invention, it will be appreciated that the invention is susceptible to modification, variation and change without departing from the proper scope and fair meaning of the accompanying claims.

What is claimed is:

1. A window clamp for an automotive window regulator assembly, the window clamp comprising:

a foundation forming a shelf bordered by a wall protruding from the foundation and at least one tab protruding from the foundation and opposing the wall;

a U-shaped bridge having a first arm and a second arm extending from the foundation, the bridge forming a first claw and a second claw disposed on a top portion of the bridge spanning the first and second arms, the bridge further forming a first shoulder protruding from the first arm and a second shoulder protruding from the second arm; and a slot formed between the wall protruding from the foundation and the U-shaped bridge, the slot bottoming out at the shelf; and a groove formed in the foundation to slidably engage with a guide rail, wherein the first claw and the second claw are on opposite sides of the groove.

2. The window clamp according to claim 1, wherein the U-shaped bridge is configured to bend away from the foundation by deflecting at a first hinge region and a second hinge region located along the first arm and second arm, respectively.

3. The window clamp according to claim 2, wherein the first and second arms have a tapered cross section such that the arms are narrow near where the arms connect to the foundation, creating the first and second hinge regions.

4. The window clamp according to claim 1, wherein the top portion of the bridge spanning the first and second arms is reinforced with a plurality of truss structures formed in the material of the top portion to increase structural rigidity near the first claw.

5. The window clamp according to claim 1, wherein the first shoulder and the second shoulder have a curved surface.

6. The window clamp according to claim 1, wherein the first and second shoulders are over-molded with thermoplastic elastomers to reduce noise.

7. The window clamp according to claim 1, wherein the window clamp is formed using injection molding.

8. The window clamp according to claim 1, wherein the automotive window regulator assembly is a single rail type regulator.

9. The window clamp according to claim 1, wherein the slot is configured to receive a panel having a first hole and wherein the first claw is configured to interlock with the first hole of the panel.

10. The window clamp according to claim 1, wherein the slot is configured to receive a panel having a first hole and a second hole and wherein the first claw is configured to interlock with the first hole of the panel and the second claw is configured to interlock with the second hole of the panel.

11. A window clamp assembly for an automotive window regulator assembly, the window clamp assembly comprising:

a panel having a lower edge, a first hole positioned at a predetermined location relative to the lower edge, and a second hole positioned at a predetermined location relative to the lower edge and the first hole;

a foundation forming a shelf bordered by a wall protruding form the foundation and at least one tab protruding from the foundation and opposing the wall, the shelf configured to engage the lower edge of the panel;

a U-shaped bridge having a first arm and a second arm extending from the foundation, the bridge forming a first claw and a second claw disposed on a top portion of the bridge spanning the first and second arms, the first claw configured to interlock with the first hole disposed in the panel and the second claw configured to interlock with the second hole disposed in the panel, the bridge further forming a first shoulder protruding from the first arm and a second shoulder protruding from the second arm, the first and second shoulders configured to guide the panel; and a slot formed between the wall protruding from the foundation and the U-shaped bridge, the slot bottoming out at the shelf.

12. The window clamp assembly according to claim 11, wherein the U-shaped bridge is configured to bend away from the foundation by deflecting at a first hinge region and a second hinge region located along the first arm and second arm respectively, to allow the panel to be inserted into the slot.

13. The window clamp assembly according to claim 11, wherein the first and second arms have a tapered cross section such that the arms are narrow near where the arms connect to the foundation, creating the first and second hinge regions.

14. The window clamp assembly according to claim 11, wherein the top portion of the bridge spanning the first and second arms is reinforced with a plurality of truss structures formed in the material of the top portion to increase structural rigidity near the first and second claws.

15. The window clamp assembly according to claim 11, wherein the first shoulder and the second shoulder are curved such that the shoulder maintains a substantially constant distance to the panel when the first and second arms are deflected during installation of the panel.

16. The window clamp assembly according to claim 11, wherein the first and second shoulders are over-molded in thermoplastic elastomers to reduce noise.

17. The window clamp assembly according to claim 11, wherein the window clamp is formed using injection molding.

18. The window clamp assembly according to claim 11, wherein the automotive window regulator assembly is a single rail type regulator.

19. A window clamp assembly for an automotive window regulator assembly, the window clamp assembly comprising:

a panel having a lower edge, a first hole positioned at a predetermined location relative to the lower edge, and a second hole positioned at a predetermined location relative to the lower edge and the first hole;

a foundation forming a shelf bordered by a wall protruding form the foundation and at least one tab protruding from the foundation and opposing the wall, the shelf configured to engage the lower edge of the panel;

a U-shaped bridge having a first arm and a second arm extending from the foundation, the bridge forming a first claw and a second claw disposed on a top portion of the bridge spanning the first and second arms, the first claw configured to interlock with the first hole disposed in the panel and the second claw configured to interlock with the second hole disposed in the panel, the bridge further forming a first shoulder protruding from the first arm and a second shoulder protruding from the second arm, the first and second shoulders configured to guide the panel;

a slot formed between the wall protruding from the foundation and the U-shaped bridge, the slot bottoming out at the shelf; and a groove formed in the foundation to slidably engage with a guide rail.

* * * * *